United States Patent [19]

Modell

[11] 3,994,091

[45] Nov. 30, 1976

[54] CARD MANIPULATABLE TO EFFECT ANIMATION OF A PICTURE THEREON

[76] Inventor: Franklyn Bruce Modell, 26 W. 9th St., New York, N.Y. 10011

[22] Filed: June 11, 1975

[21] Appl. No.: 585,852

[52] U.S. Cl. ..... 46/37; 40/124.1; 40/126 A; 46/154; 352/52

[51] Int. Cl.[2] ..... A63H 33/22

[58] Field of Search ..... 46/35, 36, 37, 154, 46/135 R, 34; 352/99, 98, 52; 40/78.11, 106.51, 126 A, 124.1

[56] References Cited

UNITED STATES PATENTS

| | | | |
|---|---|---|---|
| 862,671 | 8/1907 | Smith | 40/106.51 |
| 976,495 | 11/1910 | Reeves | 46/135 R X |
| 1,369,093 | 2/1921 | Fisher | 46/157 X |
| 1,419,657 | 6/1922 | Akroyd | 46/37 X |
| 2,171,533 | 9/1939 | Barbelle | 46/37 |
| 2,259,205 | 10/1941 | Heilpern | 46/37 |
| 2,392,991 | 1/1946 | Macomber | 40/126 A |
| 2,420,986 | 5/1947 | Smith | 46/36 |
| 2,571,744 | 10/1951 | Mihoudas | 46/154 X |
| 2,709,319 | 5/1955 | Baltin | 46/154 |
| 2,935,185 | 5/1960 | Will | 40/126 A X |
| 3,487,573 | 1/1970 | Slovacek | 40/124.1 |
| 3,521,399 | 7/1970 | Deal | 46/154 |

*Primary Examiner*—F. Barry Shay
*Attorney, Agent, or Firm*—Edmund A. Fenander

[57] ABSTRACT

In a card which has a picture and is bent intermediate its ends to enable the card to be moved between an extended position in which a part of the picture at the region of the bend is visible and a contracted position in which the part of the picture at the region of the bend is concealed from view, effecting animation of the picture by imparting movement to that part of the picture which alternately becomes visible and concealed from view at the region of the bend when the card is successively stretched and shortened between its extended and contracted positions.

10 Claims, 18 Drawing Figures

V

V 210
211
212
214
218
219
220
221
222
223
224
227
228
35
36
31
31a
31b
32
33
34

CARD MANIPULATABLE TO EFFECT ANIMATION OF A PICTURE THEREON

SUMMARY OF THE INVENTION

My invention relates to cards having pictures which can be manipulated to effect animation of the pictures thereon.

The object of my invention is to provide a picture card of this type which is of simplified construction and inexpensive to fabricate. I accomplish this by providing a picture card which is bent intermediate its ends and can be moved between extended and contracted positions to effect animation of at least a part of the picture thereon.

DESCRIPTION OF THE PREFERRED EMBODIMENT

Figures 1, 2, 3, 4, 5, 6:
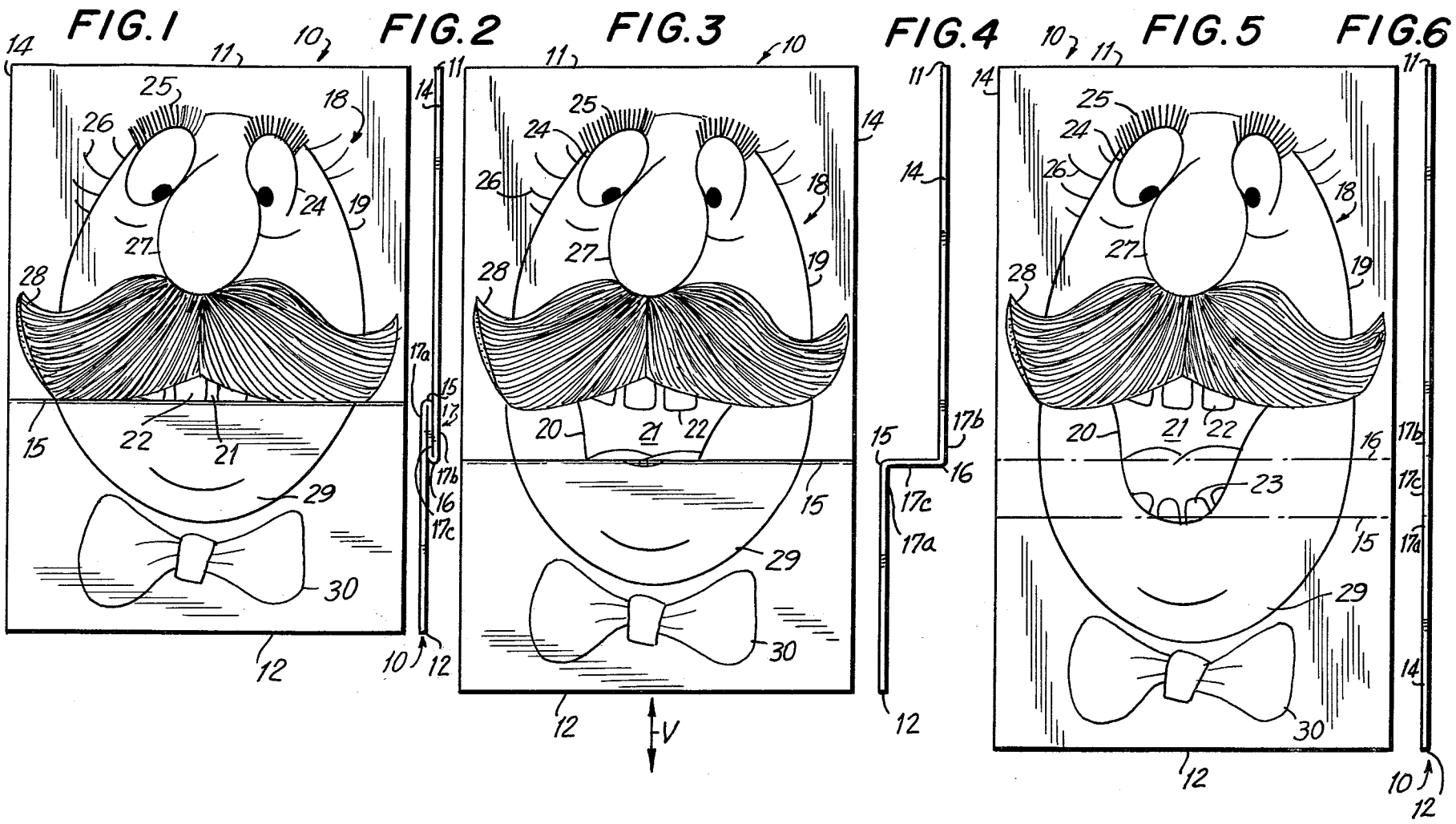
FIG. 1 is a front elevation of a card which embodies my invention and has a picture thereon, the card being in its fully contracted position.
FIG. 2 is an end view of the card shown in FIG. 1.
FIG. 3 is a view similar to FIG. 1 with the card in a partially extended position.
FIG. 4 is an end view of the card shown in FIG. 3.
FIG. 5 is a view similar to FIGS. 1 and 3 with the card in its fully extended position.
FIG. 6 is an end view of the card shown in FIG. 5.

Referring to FIGS. 1 to 6 of the drawing, I have shown my invention applied to a rectangular card 10 formed of a stiff piece of paper or thin pasteboard and of a kind used in making greeting cards, the card having a top 11, bottom 12 and sides 14. Intermediate the top 11 and bottom 12 the card is bent at 15 and 16 to form a pleat 17 which extends across the card between the sides 14.

As seen in FIG. 2, the pleat 17 is essentially S-shaped in section and produced by the joining of two U-shaped portions, the outer arms of which extend vertically in opposite directions. By providing the pleat 17 the card 10 can be stretched and shortened between its extended and contracted positions illustrated in FIGS. 5 and 1, respectively.

As shown in FIG. 2, the pleat 17 has two outer layers **17*a* and 17*b* and an intermediate or inner layer 17*c* which is common to the two U-shaped portions of the essentially S-shaped pleat 17. In the contracted position of the card 10 illustrated in FIG. 2, the layers 17*a*, 17*b* and 17*c* of the pleat overlap one another and are at the same elevation. When the card 10 is stretched from its contracted position in FIG. 1 to its extended position in FIG. 5, as by grasping the top 11 and bottom 12 of the card 10 by the hands and manually moving them apart, for example, the layers 17*a*, 17*b* and 17*c* of the pleat move from their overlapping positions in FIG. 2 to a more or less straight line position in FIG. 6 in which the layers 17*a*, 17*b* and 17*c*** essentially are in the same vertical plane.

To form the pleat 17 and facilitate movement of the card 10 between its extended and contracted positions, the card can be creased horizontally between the sides 14 to provide the bends at 15 and 16 and form the inner layer **17*c* of the pleat, the creases at the bends 15 and 16 serving as hinges about which the inner pleat layer 17*c* can swing. Alternatively, when the card is sufficiently thick and it becomes desirable to do so, horizontal unsevered scorings can be made in the card between the sides 14 to provide the bends at 15 and 16 and form the inner pleat layer 17*c*, the unsevered scorings at the bends 15 and 16 serving as hinges about which the inner pleat layer 17*c*** can swing to facilitate movement of the card between its extended and contracted positions.

During movement of the card 10 between its contracted position in FIG. 1 and extended position in FIG. 5, the inner layer **17*c* of the pleat 17 moves through a horizontal position shown in FIG. 4. In this position the card 10 is zee-shaped in section and essentially midway between its contracted and extended positions shown in FIGS. 2 and 6**, respectively.

A picture 18 is illustrated on the card 10 which, in the embodiment being described, can be referred to as a cartoon which shows the head 19 of a man in caricature. In the extended position of card 10 shown in FIG. 5, all of the features of the head 19 are visible. These features include the mouth 20 which is wide open, the cavity 21 within the mouth and the upper and lower teeth 22 and 23, respectively.

In FIG. 3, in which the card 10 is essentially midway between its contracted and extended positions of FIGS. 1 and 5, respectively, the mouth 20 is partially closed, the cavity 21 is smaller than seen in FIG. 5 and the lower teeth 23 are concealed from view and no longer visible. And in FIG. 1, in which the card 10 is in its contracted position, the mouth 20 is practically closed with only portions of the upper teeth 22 visible and the cavity 21 essentially concealed from view.

In FIGS. 1, 3 and 5 it will be seen that the features of the top part of the head 19 remain the same in the contracted and extended positions of the card 10. These features include the eyes 24, eyebrows 25, hair 26, nose 27 and moustache 28. In FIGS. 1, 3 and 5, it also will be seen that the chin 29 and tie 30 in the bottom part of the picture remain the same in the contracted and extended positions of the card 10.

In accordance with my invention, animation of the picture 18 is effected with movement of that part thereof which alternatively becomes visible and concealed from view at the region of the bends 15 and 16 when the card 10 is successively stretched and shortened between its extended and contracted positions. When the inner pleat layer 17c can move without difficulty from its horizontal position in **17*c* 4 toward and from its vertical positions in FIGS. 2 and 6, respectively, by reason of the fact that the hinges formed at the bends 15 and 16 are not tight, the card can readily be moved vertically between its extended and contracted positions by grasping the top 11 of the card 10 by the hand and rapidly moving it up and down, as indicated by the double-arrowed line V in FIG. 3. When the hinges formed at the bends 15 and 16 are tight and the inner pleat layer 17*c* cannot move freely with respect to the portions of the card 10 extending upward and downward therefrom, the card 10 can be grasped by the hands at both the top 11 and bottom 12** to move it between its extended and contracted positions.

When the card 10 is rapidly moved between its contracted and extended positions to effect animation of the picture 18 it is possible the card, when moving from its position in FIG. 4 toward its positions in FIGS. 2 and 6, respectively, will not reach its positions in FIGS. 2 and 6. However, the card 10 in such instances will be moved a sufficient distance from its position in FIG. 4 toward its positions in FIGS. 2 and 6 to effect animation of the picture 18.

As pointed out above, animation of the picture 18 is effected by parts thereof alternately becoming visible and concealed from view as the card is moved back and forth between its positions in FIGS. 2 and 6. Further, animation is enhanced by the fact that the shape of parts of the picture 18 and features illustrated change when the card is moved between its extended and contracted positions. In the embodiment being described, for example, the shape of the head 19 changes in appearance when the card 10 is moved between its contracted, extended and midway positions, as illustrated in FIGS. 1, 5 and 3, respectively. This change of shape of the head 19 is constantly accompanied by changes in the look or expression of the face from one of mirth, amusement or derision to one which is solemn, sober, grave or grim.

Further, the pleat 17 in the card 10 is of such a character that features of the face of the picture 18 appear three dimensional when the card is moved between its contracted and extended positions. This is due to the fact that the inner pleat layer 17*c* swings through an obtuse angle between its positions in FIGS. 1 and 5. In such swinging movement the features illustrated at the inner pleat layer 17*c* move from and toward the viewer. Also, portions of the card 10 extending upward and downward from the region of the bends at 15 and 16 move toward and from the viewer when the card is moved between its contracted and extended positions.

Figures 7, 8, 9, 10, 11, 12:
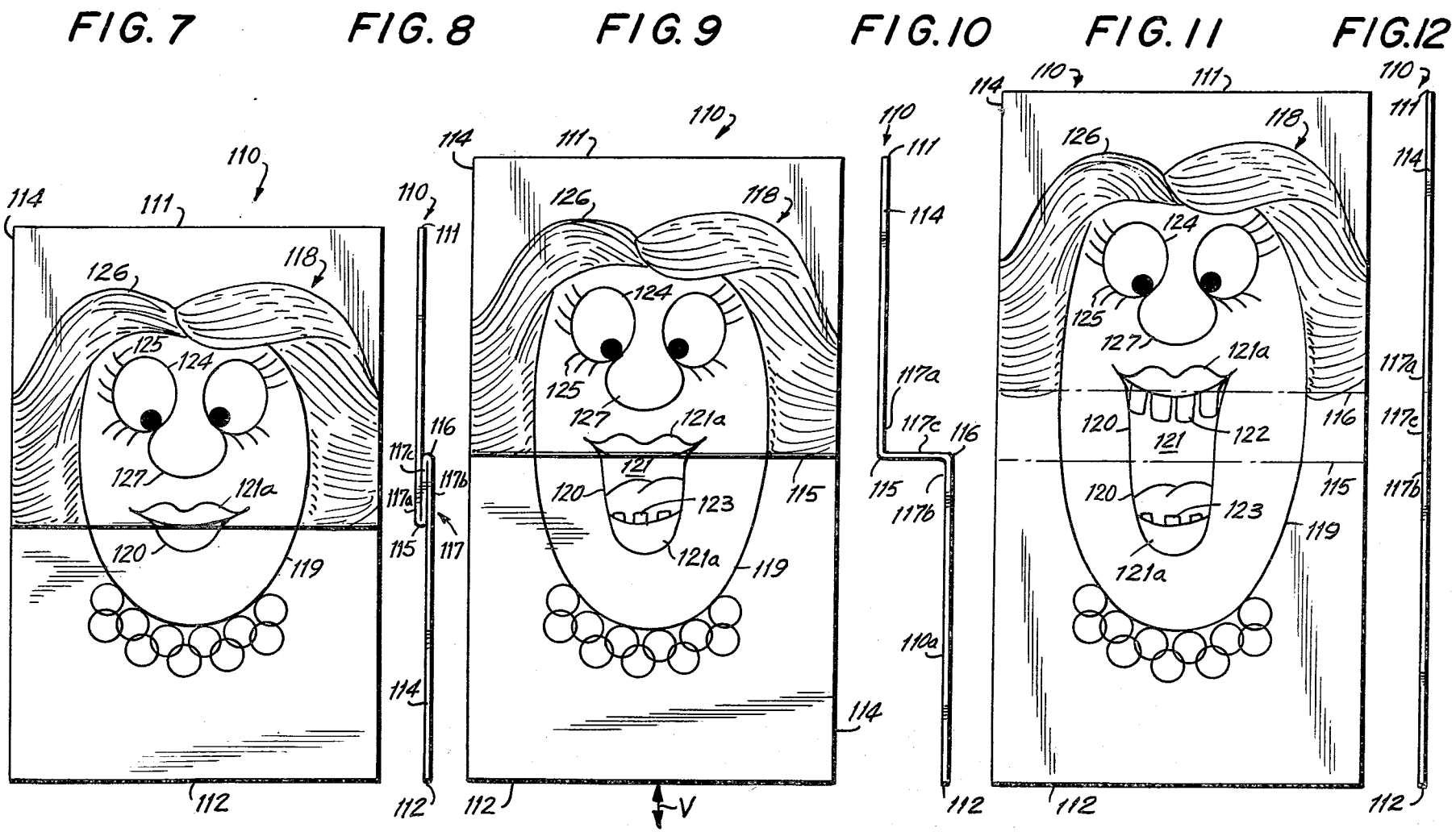
FIGS. 7 to 12, which illustrate another embodiment of my invention, are similar to FIGS. 1 to 6, respectively.

Another embodiment of the invention is shown in FIGS. 7 to 12 which are generally similar to FIGS. 1 to 6 with similar parts referred to by the same reference numerals to which 100 has been added. The embodiment of FIGS. 7 to 12 differs from the first-described embodiment in that the pleat 117 in FIG. 8 is reversed from the pleat 17 in FIG. 2. When the inner pleat layer 17*c* in FIG. 2 moves to its horizontal position with movement of the card 10 from its contracted position in FIG. 1, the inner pleat layer 17*c* extends rearward from the bottom part 10*a* of the card 10 toward the upper part 10*b* thereof. When the inner pleat layer 117*c* in FIG. 8 moves to its horizontal position in FIG. 10 with movement of the card 110 from its contracted position in FIG. 7, the inner pleat layer 117*c* extends forward from the bottom part 110*a* of the card 110 toward the upper part 110*b* thereof.

In other respects, the embodiment of FIGS. 7 to 12 is like the first-described embodiment with the pleat 117 having outer layers 117*a* and 117*b* between the inner pleat layer 117*c*. The picture 118 illustrates the head 119 of a woman in caricature whose features are all shown in the extended position of the card 110. These include the mouth 120 which is wide open, the cavity 121 within the mouth, the lips 121*a*, and the upper and lower teeth 122 and 123, respectively. Further features shown in the top part of the head include the eyes 124, eye-lashes 125, hair 126 and nose 127.

As in the first described embodiment, animation of the picture 118 is effected with movement of that part thereof which alternately becomes visible and concealed from view at the region of the bends 115 and 116 when the card 110 is successively stretched and shortened between its extended and contracted positions. Further, animation is enhanced by the fact that the shape of the head changes when the card 110 is moved between its extended and contracted positions. As in the first-described embodiment, the change in shape of the head 119 changes the look or expression of the face.

A further embodiment of the invention is shown in FIGS. 13 to 18 which are generally like FIGS. 1 to 6 with like parts referred to by the same reference numerals to which 200 has been added. The embodiment of FIGS. 13 to 18 differs from the first-described embodiment in that, in the contracted position of the card 210 in FIG. 14, the pleat 31 is U-shaped in section and extends horizontally towards its closed end 32 from bends at 33 and 34 in the card 210. The bends at 33 and 34 and at the closed end 32 of the pleat 31 can be formed by creasing the card 210 or providing unsevered scorings in the card if it becomes desirable to do so, as explained above in describing the first-described embodiment. It this way the bends at 33 and 34 and at the closed end 32 of the pleat 31 serve as hinges for moving the card 210 between its contracted and extended positions shown in FIGS. 14 and 18 and through its intermediate position shown in FIG. 16 in which the opposing layers or sides 31*a* and 31*b* of the pleat 31, in section, assume a V-shape.

As in the first-described embodiment, the picture 218 in the embodiment of FIGS. 13 to 18 illustrates the head 219 of a man in caricature whose features are all shown in the extended position of the card 210. These include the mouth 220 which is wide open, the cavity 221 within the mouth, and the upper and lower teeth 222 and 223, respectively. Further features include the eyes 224, nose 227, moustache 228, eye-glasses 35 and beard 36.

As in the first-described embodiment, animation of the picture 218 is effected with movement of that part thereof which alternately becomes visible and concealed from view at the region of the bends 33 and 34 when the card 210 is successively stretched and shortened between its extended and contracted positions. Further, animation is enhanced by the fact that the shape of the head 219 changes when the card 210 is moved between its extended and contracted positions. This change in the shape of the head 219 changes the look or expression of the face.

In the embodiments of the invention which are illustrated and have been described, the part of the picture which alternately becomes visible and concealed from view when the card is extended and contracted is at the vicinity of the mouth of the person shown. It will be understood that the part of the picture alternately visible and concealed from view when the card is extended and contracted can be at any part of the picture which normally is movable and capable of depicting action. The part of the picture alternately visible and concealed from view when the card is extended and contracted also can be a part of the picture which normally is stationary. When the picture illustrates a man wearing a tall hat, for example, the card can be formed with bends at the vicinity of the hat to change its height when the card is extended and contracted. In this way animation can be effected to create amusement, attract attention and be educational and informative.

In view of the foregoing, it will now be understood that in each of the embodiments illustrated and described above, the bends or creases, which serve as hinges, extend from one side to the opposite side of the card across the picture and intersect the latter at an intermediate region between the top and bottom edges of the card. Further, the top and bottom parts of the card, each of which has a different portion of the picture thereon, extend upward and downward, respectively, from such intermediate region and are joined thereto.

Figures 13, 14, 15, 16, 17, 18:
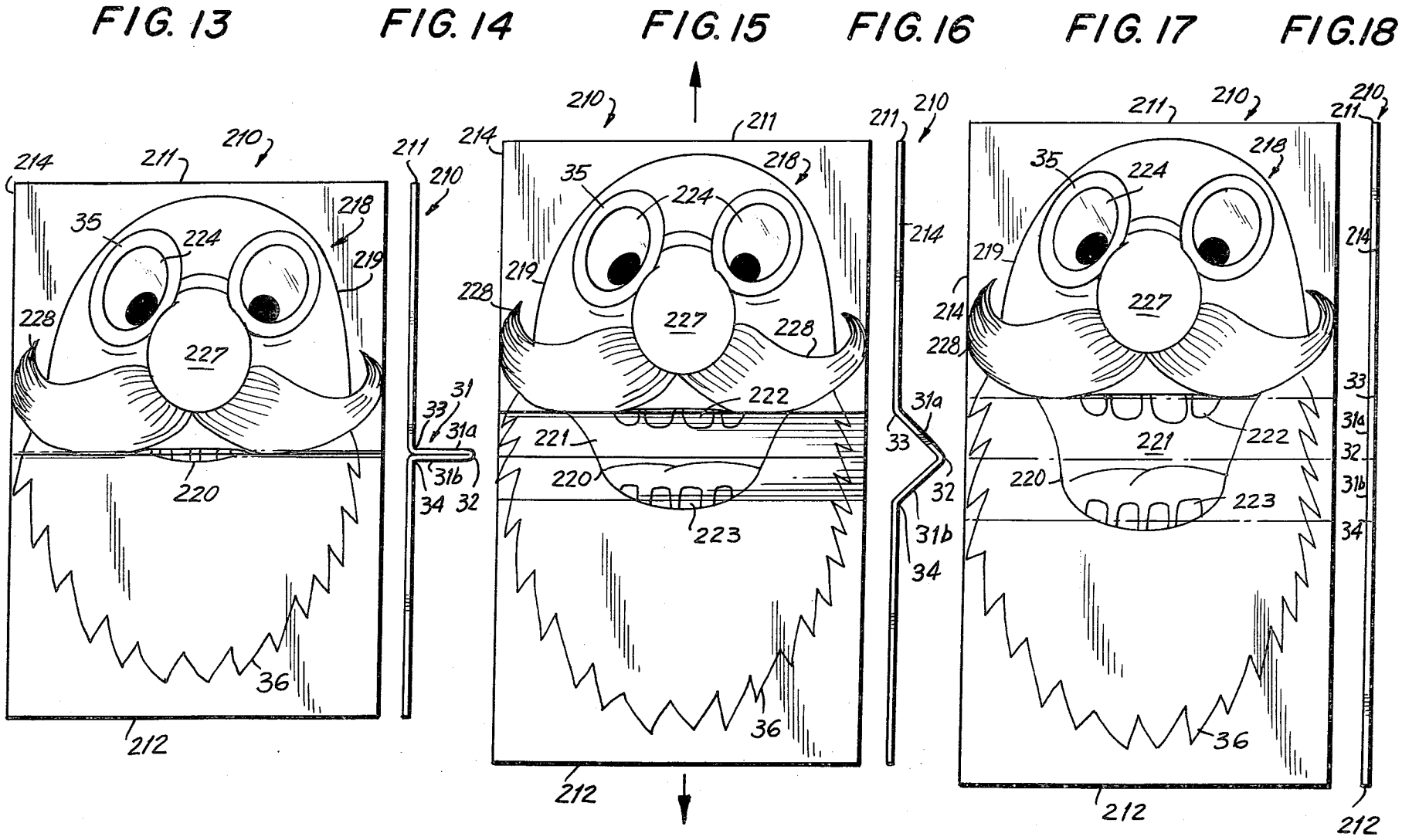
FIGS. 13 to 18, which illustrate a further embodiment of my invention, are generally similar to FIGS. 1 to 6, respectively.

In each of the embodiments the card in its contracted position is bent back upon itself at the vicinity of the bends with adjacent parts overlapping one another, as shown in FIGS. 2, 8 and 14. Also, in their extended positions all parts of each card, including the adjacent parts at the vicinity of the bends, are in alignment in the plane of the card, as shown in FIGS. 6, 12 and 18. A particularly important feature of the invention is that in each embodiment the picture visible to the viewer is unbroken and complete in both the extended and contracted positions of the card and intermediate positions therebetween. For example, in the embodiment of FIGS. 1 to 6, this is readily evident by comparing FIGS. 1, 3 and 5.

Another important feature of the invention is that when the card is rendered movable toward and from its contracted position responsive to force applied thereto, all of the bends function as hinges at the same time to promote such movement of the card. For example, in the embodiment of FIGS. 1 to 6, the bends 15 and 16 function as hinges at the same time when the card is moved between its contracted and extended positions seen in FIGS. 2 and 6, respectively. And in the embodiment of FIGS. 13 to 18, the bends 32, 33, and 34 function as hinges at the same time when the card is moved between its contracted and extended positions seen in FIGS. 14 and 18, respectively.

The word "picture" as used above and in the claims should be interpreted to include a drawing, painting, sketch, photograph or other representation, as of a person, object or scene executed on a flat surface.

I claim:

1. The combination of a. a card comprising a stiff piece of paper or the like, b. a picture on at least one face of said card, c. said card having a plurality of bends which serve as hinges and extend from one side to the opposite side thereof across the picture and intersect the latter, said bends being disposed at a region between the top and bottom edges of said card, d. top and bottom parts of said card, each of which has a different portion of the picture thereon, extending upward and downward, respectively, from said region and joined thereto, e. said card in a contracted position being bent back upon itself at the vicinity of said bends with adjacent parts overlapping one another and in an extended position having all parts of said card, including said adjacent parts at the vicinity of said bends, in alignment in the plane of said card, f. all parts of said card upon which the picture is illustrated being in the plane of said card when it is in its extended position, g. the picture visible to a viewer being unbroken and complete in both the extended and contracted positions of said card and intermediate positions therebetween, h. means comprising said bends to render said card movable toward and from its contracted position responsive to force applied thereto, all of said bends functioning as hinges at the same time to promote such movement of said card toward and from its contracted position, i. said overlapping parts and bends functioning to conceal from view a portion of said picture at the region of said bends when said card is in its contracted position and to render at least a part of said portion visible when said card is moved from its contracted position, and j. effecting animation of the picture with movement of that portion thereof which alternately becomes concealed from view and visible at the region of said bends when said card is moved toward and from its contracted position responsive to force applied thereto.

2. The combination set forth in claim 1 in which said means comprising said bends includes further provisions to move from and toward the viewer, to impart a three-dimensional effect, that portion of the picture at the region of said bends which is rendered concealed from view and visible when said card is moved toward and from its contracted position, respectively.

3. The combination set forth in claim 1 in which the picture includes at least one feature which is capable of movement depicting action, said means comprising said bends being at the region of said feature, and the portion of the picture concealed from view when said card is moved toward its contracted and visible when said card is moved from its contracted position including at least a portion of said feature.

4. The combination set forth in claim 1 in which said means to render said card movable toward and from its contracted position responsive to force applied thereto comprises a pleat formed by the adjacent overlapping parts of said card.

5. The combination set forth in claim 4 in which said pleat is S-shaped in section in the contracted position of said card.

6. The combination set forth in claim 4 in which said pleat is U-shaped in section in the contracted position of said card.

7. The combination set forth in claim 1 in which the picture comprises the head of a person having a mouth which is open when said card is extended and moves toward its closed position when said card is contracted, said adjacent overlapping parts of said card being at the region of the mouth of the picture, and the portion of the picture concealed from view when said card is in its contracted position and visible when said card is moved from its contracted position comprising at least a portion of the mouth.

8. The combination set forth in claim 1 in which the picture comprises the head of a person, said adjacent overlapping parts of said card being at the region of a part of the head, the animation which is effected changing the shape of the head with movement of that portion of the head which alternately becomes visible and concealed from view when said card is successively stretched and shortened between its extended and contracted positions, respectively.

9. The combination set forth in claim 8 in which the head of the person in the picture illustrates features including the mouth and upper and lower teeth, respectively, said adjacent overlapping parts of said card being at the region of that portion of the head including the mouth and teeth, the animation which is effected also changing the shape of the mouth and number of teeth seen with movement of that portion of the head which alternately becomes visible and concealed from view when said card is successively stretched and shortened between its extended and contracted positions, respectively.

10. The combination set forth in claim 8 in which the head is of one height when said card is in its contracted position and of greater height when said card is moved toward its extended position.

* * * * *